US009145676B2

(12) United States Patent
Long et al.

(10) Patent No.: US 9,145,676 B2
(45) Date of Patent: Sep. 29, 2015

(54) MASONRY BLOCK WITH TAPER

(75) Inventors: Eric Y. Long, Sewell, NJ (US); John E. Ravelli, Dorothy, NJ (US); John J. Lindberg, Pottstown, PA (US)

(73) Assignee: E.P. Henry Corporation, Woodbury, NJ (US)

( * ) Notice: Subject to any disclaimer, the term of this patent is extended or adjusted under 35 U.S.C. 154(b) by 0 days.

(21) Appl. No.: 13/292,703

(22) Filed: Nov. 9, 2011

(65) Prior Publication Data

US 2013/0111842 A1 May 9, 2013

(51) Int. Cl.

| | |
|---|---|
| ***E04B 5/04*** | (2006.01) |
| ***E04B 2/12*** | (2006.01) |
| ***E04C 1/39*** | (2006.01) |
| *E04C 1/41* | (2006.01) |
| *E04C 3/34* | (2006.01) |
| *E02D 29/02* | (2006.01) |
| *E04B 2/02* | (2006.01) |

(52) U.S. Cl.

CPC . *E04B 2/12* (2013.01); *E04C 1/395* (2013.01); *E02D 29/025* (2013.01); *E02D 29/0266* (2013.01); *E04B 2002/0206* (2013.01); *E04B 2002/0265* (2013.01); *E04C 1/41* (2013.01); *E04C 3/34* (2013.01)

(58) Field of Classification Search

CPC ..... E02D 29/025; E02D 29/0266; E04C 1/41; E04C 3/34; E04C 1/395; E04B 2002/0265; E04B 2002/0206; E04B 2002/0293; E04B 2/12

USPC ..... 52/302.4, 574, 604, 608, 609

See application file for complete search history.

(56) References Cited

U.S. PATENT DOCUMENTS

| | | | | | |
|---|---|---|---|---|---|
| 1,086,975 | A | * | 2/1914 | aaronson | 428/141 |
| 4,123,881 | A | | 11/1978 | Muse | |
| 4,433,521 | A | * | 2/1984 | Dietrich | 52/302.4 |
| 4,738,059 | A | * | 4/1988 | Dean, Jr. | 52/98 |
| 4,869,660 | A | * | 9/1989 | Ruckstuhl | 425/195 |
| 5,064,313 | A | * | 11/1991 | Risi et al. | 405/284 |
| 5,082,438 | A | | 1/1992 | Rook et al. | |
| 5,183,616 | A | | 2/1993 | Hedrick | |
| 5,484,236 | A | | 1/1996 | Gravier | |
| 5,490,363 | A | * | 2/1996 | Woolford | 52/604 |
| 5,622,456 | A | * | 4/1997 | Risi et al. | 405/284 |
| 5,624,211 | A | * | 4/1997 | Anderson et al. | 405/286 |
| 5,653,558 | A | * | 8/1997 | Price | 405/284 |
| 5,735,643 | A | | 4/1998 | Castonguay et al. | |
| 5,802,797 | A | * | 9/1998 | Storer-Folt | 52/604 |
| 5,809,720 | A | * | 9/1998 | Sauve | 52/302.4 |
| 5,816,749 | A | | 10/1998 | Bailey, II et al. | |
| 6,138,426 | A | * | 10/2000 | Mork et al. | 52/562 |
| 6,168,354 | B1 | * | 1/2001 | Martin et al. | 405/284 |
| 6,209,848 | B1 | | 4/2001 | Bolles et al. | |

(Continued)

*Primary Examiner* — Brian Glessner
*Assistant Examiner* — Joshua Ihezie
(74) *Attorney, Agent, or Firm* — Baker & Hostetler LLP

(57) ABSTRACT

A cast block for use in a wall is provided. The block includes: a body including a top surface and an opposed bottom surface; and a face portion extending frontwardly from the body portion, the face portion including a front surface, an upper tapered surface, and a lower tapered surface, the upper tapered surface disposed between the top surface and the front surface and the lower tapered surface disposed between the bottom surface and the front surface; wherein the front surface, the upper tapered surface, and the lower tapered surface are each patterned. Also provided is a wall formed of rows of cast blocks. Also provided is a method of forming masonry blocks for use in structural retaining walls.

20 Claims, 6 Drawing Sheets

(56) References Cited

U.S. PATENT DOCUMENTS

| | | | | |
|---|---|---|---|---|
| 6,226,951 | B1 * | 5/2001 | Azar | 52/604 |
| D464,149 | S * | 10/2002 | Risi et al. | D25/113 |
| 6,490,837 | B1 * | 12/2002 | Dueck et al. | 52/592.6 |
| D482,133 | S | 11/2003 | Scherer et al. | |
| D486,246 | S | 2/2004 | Manthei | |
| 6,763,644 | B1 * | 7/2004 | Toledo | 52/592.6 |
| 6,773,642 | B1 | 8/2004 | Wardell | |
| 6,803,002 | B2 | 10/2004 | Suto et al. | |
| 6,821,058 | B1 * | 11/2004 | Dawson | 405/284 |
| 6,854,220 | B2 * | 2/2005 | Dueck et al. | 52/100 |
| 6,948,282 | B2 * | 9/2005 | Bott | 52/98 |
| D518,578 | S | 4/2006 | Mugge et al. | |
| 7,059,808 | B2 * | 6/2006 | Risi | 405/284 |
| D529,195 | S * | 9/2006 | Mugge | D25/113 |
| D529,628 | S | 10/2006 | Mugge et al. | |
| D532,910 | S | 11/2006 | Mugge et al. | |
| 7,140,867 | B2 | 11/2006 | Scherer et al. | |
| 7,396,190 | B2 * | 7/2008 | Price | 405/284 |
| 7,458,800 | B2 | 12/2008 | Scherer et al. | |
| 7,461,490 | B2 * | 12/2008 | Toledo | 52/605 |
| D586,478 | S | 2/2009 | Price et al. | |
| 7,695,268 | B2 | 4/2010 | Klettenberg | |
| D617,912 | S | 6/2010 | Thomassen | |
| D619,732 | S | 7/2010 | Mugge et al. | |
| 7,780,141 | B2 * | 8/2010 | Dawson et al. | 249/129 |
| 7,862,763 | B2 | 1/2011 | Tufts et al. | |
| 7,963,727 | B1 * | 6/2011 | Wauhop | 405/286 |
| 8,079,195 | B2 * | 12/2011 | Cables | 52/572 |
| 8,132,988 | B2 * | 3/2012 | Dawson et al. | 405/286 |
| 8,201,376 | B2 * | 6/2012 | Witcher | 52/565 |
| 2002/0187010 | A1 * | 12/2002 | MacDonald et al. | 405/284 |
| 2003/0009970 | A1 * | 1/2003 | MacDonald et al. | 52/562 |
| 2003/0074856 | A1 * | 4/2003 | Hammer | 52/604 |
| 2003/0160147 | A1 * | 8/2003 | Manthei | 249/171 |
| 2007/0289247 | A1 | 12/2007 | Hamel | |
| 2008/0315458 | A1 | 12/2008 | Ott | |
| 2009/0000234 | A1 * | 1/2009 | Bott et al. | 52/604 |
| 2009/0277121 | A1 | 11/2009 | Scherer et al. | |
| 2010/0192502 | A1 * | 8/2010 | Mugge et al. | 52/561 |

* cited by examiner

MASONRY BLOCK WITH TAPER

TECHNICAL FIELD

This invention relates building products, and more particularly to masonry structures for building walls, and corresponding methods of forming building products.

BACKGROUND

Blocks used to form landscaping walls, such as retaining walls and decorative walls, are well known. Often, homeowners or hardscaping professionals build walls by stacking cast blocks having planar top and bottom surfaces. Alternatively, natural stone walls may be formed by skilled personnel in a labor intensive process.

Several cast blocks have been marketed having a textured front face. Examples of textured front faces are disclosed in U.S. Pat. Nos. 5,735,643; D529,195; D532,910; D619,732; D482,133 and United States Patent Application Publication 2009/0277121. U.S. Pat. No. D529,628 illustrates an example of a block having imitation grout lines formed in its front face.

There is a need for improved cast blocks for forming walls.

SUMMARY

A cast block and corresponding wall system that approximate the appearance of natural stone are provided. According to one embodiment, a cast block for use in a wall includes: a body or body portion having a top surface and an opposed bottom surface; and a face portion extending frontwardly from the body, the face portion including a front surface, an upper tapered surface, and a lower tapered surface, the upper tapered surface disposed between the top surface and the front surface and the lower tapered surface disposed between the bottom surface and the front surface; wherein the front surface, the upper tapered surface, and the lower tapered surface are each patterned. The top surface of the block can define a top surface plane and the bottom surface can define a bottom surface plane and the front surface is disposed at least partially between the top surface plane and the bottom surface plane. The top surface plane and the bottom surface plane can be substantially parallel to each other and the front surface can be substantially perpendicular to the top surface plane and the bottom surface plane. At least one of the upper and lower tapered surfaces can be at least partially nonlinear, at least partially linear, or partially linear and partially nonlinear. The upper tapered surface can define an upper tapered surface plane, the top surface plane and the upper tapered surface plane defining a top taper angle. The lower tapered surface can define a lower tapered surface plane, the bottom surface plane and the lower tapered surface plane defining a bottom taper angle. The top taper angle can be greater than the bottom taper angle or the bottom taper angle can be greater than or equal to the top taper angle. The body or body portion can further include a height, the height being measured from the top surface to the bottom surface. The front surface can include an upper edge, a lower edge, and a front surface height defined by the distance between the upper edge and the lower edge of the front surface, wherein the front surface height is at least 50% of the body portion height. The face portion can further comprise a first side tapered surface that is substantially perpendicular to the first and second taper surfaces. The face portion can further comprise a second side tapered surface that is substantially perpendicular to the first and second taper surfaces. The top and bottom surfaces can be substantially smooth and the front surface can be patterned. The face portion can define a top taper depth measured from the front face to where the upper tapered surface and the top surface meet. The face portion can also define a bottom taper depth measured from the front face to where the lower tapered surface and the bottom surface meet. The body can further comprise opposed first and second side surfaces, each of the first and second side surfaces extending from the top surface to the bottom surface, and wherein the opposed first and second side surfaces are either parallel or oblique to each other. The face portion can further define: a top taper depth measured from the front face to where the upper tapered surface and the top surface meet; and a bottom taper depth measured from the front face to where the lower tapered surface and the bottom surface meet; wherein the top taper depth is shorter than bottom taper depth.

In another embodiment, a wall formed of rows of cast blocks includes: at least a first block in a first row and a second block in a second row, each of the at least first and second blocks: a body including a top surface and an opposing bottom surface; and a face portion extending from the body portion, the face portion including a front surface, an upper tapered surface, and a lower tapered surface, the upper tapered surface disposed between the top surface and the front surface and the lower tapered surface disposed between the bottom surface and the front surface; wherein the upper surface of the first block and the bottom surface of the second block are configured to be positioned relative to one another such that the lower tapered surface of the second block creates a shadow line that at least partially covers the first block. The body can further comprise opposed first and second side surfaces, each of the first and second side surfaces extending from the top surface to the bottom surface, and wherein the opposed first and second side surfaces are parallel to each other. The body can further comprise opposed first and second side surfaces, each of the first and second side surfaces extending from the top surface to the bottom surface, and wherein the opposed first and second side surfaces are oblique to each other. At least one of the front surface, the upper tapered surface, and the lower tapered surface can be patterned.

Also provided is a method of forming masonry blocks for use in structural retaining walls, the method including the steps of: providing a mold including (i) a body formed by substantially parallel longitudinal sidewalls, (ii) a tapered end section formed of tapered sidewalls extending from upper ends of the longitudinal sidewalls, and (iii) an opening at a top of the mold; inserting a concrete mix into the mold; and compacting the concrete mix in a press having a patterned surface through the opening of the mold to form a green block. The method can further include the step of curing the green block. The mold can be vertically oriented in the method. The providing step of the method can further include providing a plurality of molds arranged such that during the compacting step, a single press compacts each one of the plurality of molds in a single stroke, each one of the molds having a substantially uniform depth and height.

DETAILED DESCRIPTION OF ILLUSTRATIVE EMBODIMENTS

Figure 1:
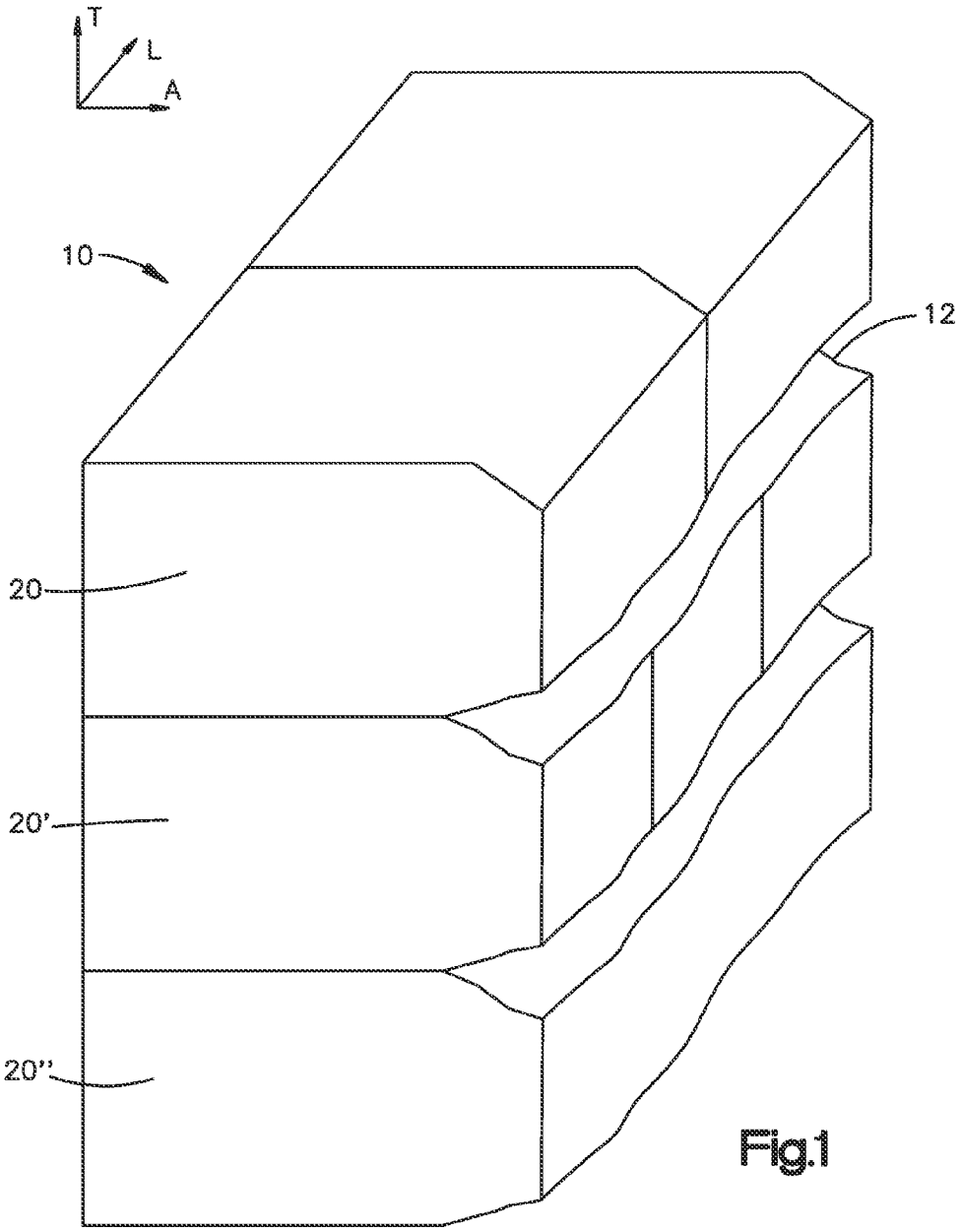
FIG. 1 is a perspective view of a wall that includes a plurality of bricks.

Certain terminology is used in the following description for convenience only and is not limiting. The terms "top" and "bottom" correspond to a nominally horizontal orientation of a block, such as for example, when a block is in an installed configuration or orientation as shown in FIG. 1. The term "rear" refers to the back side of the block and the term "front" refers to the front, nominally exposed portion of the block in its installed configuration. The term "side" refers to the lateral face of the block that connects the rear side to the front portion. The terminology includes the above-listed words, derivatives thereof and words of similar import.

Additionally, a three dimensional coordinate system is provided, the coordinate system is defined by a longitudinal axis (L-axis), a lateral axis (A-axis) that is perpendicular to the L-axis, and a transverse axis (T-axis) that is perpendicular to both the L-axis and the A-axis. The three dimensional coordinate system further includes a longitudinal direction L extends parallel to the L-axis, a lateral direction A extends parallel to an A-axis and is perpendicular to the longitudinal direction L, and a transverse direction T extends parallel to the T-axis and is perpendicular to both the longitudinal direction L and the lateral direction A. Accordingly, the terms "height", "width", and "depth" are used to describe various dimensions and measurements of the structures disclosed below. Unless specifically stated to the contrary below, height is measured in the transverse direction, width is measured along the longitudinal direction, and depth is measured along the lateral direction.

Referring to FIG. 1, a wall 10, for example a masonry wall, can be of the type used in residential or commercial landscaping, such as by a homeowner or a professional installer. The wall 10 can be formed of several rows of bricks or blocks 20. The rows of blocks 20 can be stacked on top of each other to form the shape and dimensions of the wall 10. As shown the blocks in the top row are illustrated as block 20, the blocks 20 are stacked on top of the blocks of the middle row, which are identified by reference numerals 20'. The blocks 20' of the middle row can be stacked on top of the block of the bottom row, which is identified by reference numeral 20". The blocks 20 are configured such that when the block 20 is stacked on top of block 20', a shadow line 12 is cast that at least partially covers block 20'.

The wall 10 illustrated in FIG. 1 includes three rows of blocks 20, however it will be understood that more or less rows (including one row) can be included until a desired height of the wall 10 is achieved. As shown, in one embodiment, the blocks 20 can have a substantially similar height and depth to provide for easy construction of the wall 10. However, as will be described in detail below, each of the blocks 20 included in the wall 10 can have varying heights, widths and depths which can provide a more random look.

Figure 2:
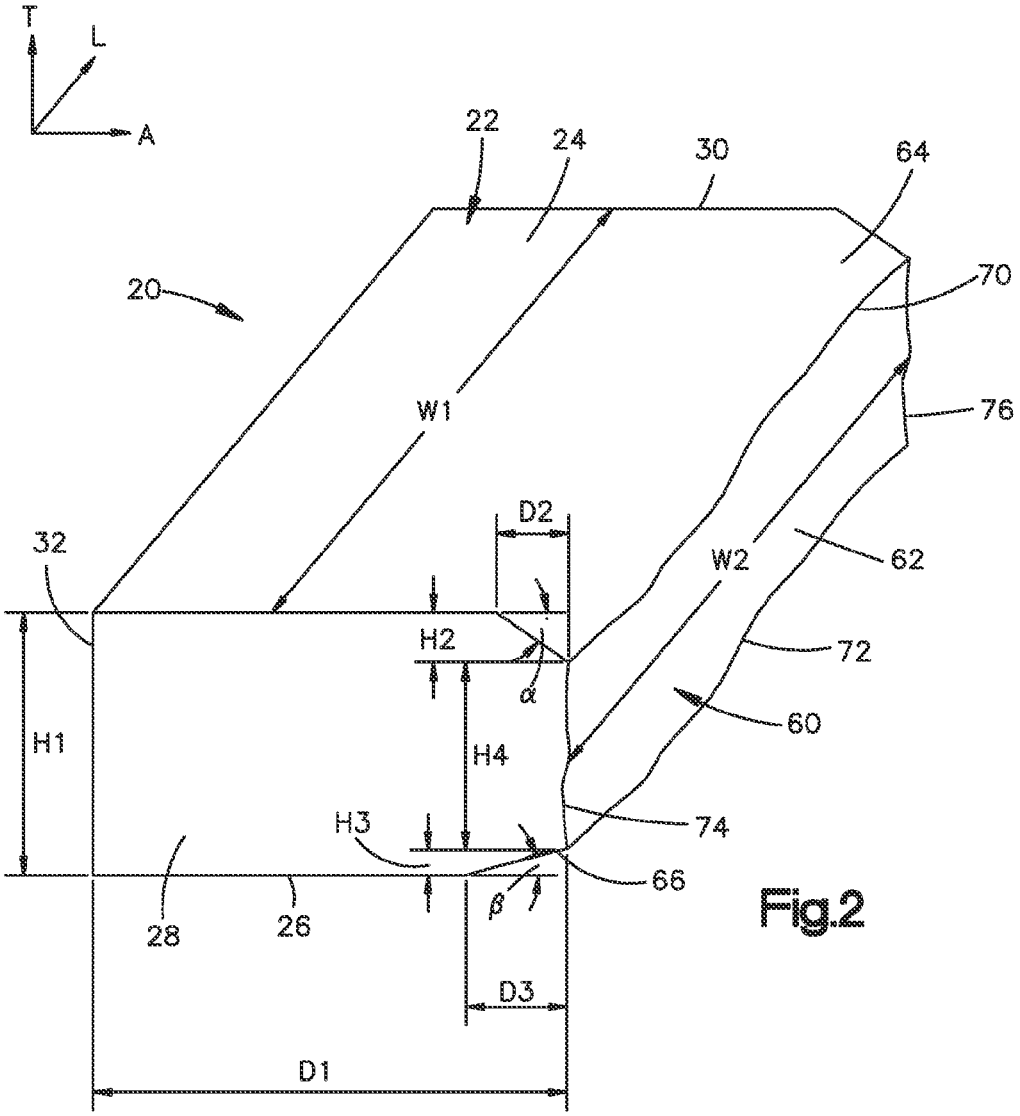
FIG. 2 is a perspective view of one of the bricks illustrated in FIG. 1 according to one embodiment, the brick including a body portion and a face portion.

Referring to FIG. 2, the block 20 can include a body 22 and a face portion 60, the face portion 60 extending frontwardly away from the body 22. The body 20 includes opposed top and bottom surfaces 24, 26; opposed first and second side surfaces 28, 30; and a rear side surface 32. Preferably, the top surface 24 and the bottom surface 26 are approximately planar such that the top surface 24 defines a top surface plane and the bottom surface 26 defines a bottom surface plane. The top surface 24 and the bottom surface 26 are each configured such that the bottom surface 26 of a first block 20 can rest on the top surface 24 of a second block 20. As the block 20 can be a masonry structure, the top and bottom surfaces 24 and 26 can be either planar or parallel or both as those terms are understood for masonry structures (rather than in an abstract or mathematical context) to enable multiple blocks 20 to be stacked on top of each other.

The first side surface 28 defines one lateral face of the block 20 and the second side surface 30 defines the opposing lateral face of the block 20. Each of the first and second side surfaces 28 and 30 can have an unpatterned surface and can also have any orientation, such as, for example, being parallel to each other and being perpendicular to each of the top and bottom surfaces 24 and 26. Alternatively, the first and second side surfaces 28 and 30 can be oblique to each other and/or also angularly offset from the top and bottom surfaces 24 and 26 at an oblique angle. The rear surface 32 defines a back side of the block 20. The rear surface 32 can have multiple orientations, for example perpendicular to both the top and bottom surfaces 24, 26 or at some other angular offset from the top and bottom surfaces 24, 26. The rear surface 32 can be an unpatterned surface. The surfaces 24, 26, 28, 30, and 32 can be planar as shown such that the labor required to lay the blocks 20 to form a wall is minimized. However other configurations are contemplated, such as, for example surfaces with features that correspond to features on the opposing surface of an adjacent block 20 to positionally secure the adjacent blocks 20 together.

The face portion 60 includes a front surface 62, an upper tapered surface 64, and a lower tapered surface 66. The upper tapered surface 64 extends between the top surface 24 and the front surface 62. As shown, in one embodiment, the upper tapered surface 64 extends forwardly and downwardly from the forward-most edge of the top surface 24 to the front surface 62. The lower tapered surface 66 extends between the bottom surface 26 and the front surface 62. As shown, in one embodiment, the lower tapered surface extends forwardly and upwardly from the forward-most edge of the bottom surface 26 to the front surface 62. The front surface 62 extends from an upper edge 70 at the forward-most edge of the upper tapered surface 64 to a lower edge 72 at the forward-most edge of the lower tapered surface 66 and from a first side edge 74 to a second side edge 76. The upper and lower tapered surfaces 64 and 66 and the front surface 62 can be patterned to resemble natural stone (for example, either rough field stone or cut stone), as will be understood by persons familiar with the hardscaping industry. Patterned surfaces on block 20 can include a varied topography (such as seemingly randomly placed peaks and valleys) that are visible to the naked eye as opposed to a mere printed pattern on an underlying flat surface that merely produces the appearance of being textured or a slightly textured, regular surface.

The upper tapered surface 64 extends downwardly and forwardly from the top surface 24 at a top taper angle α. In one embodiment the upper tapered surface 64 is planar such that the upper tapered surface 64 defines an upper taper surface plane, and the top taper angle α is defined between the top surface plane and the top taper surface plane. The upper tapered surface 64 can taper linearly from the top surface 24 to the front face 62. Alternatively the upper tapered surface 64 can taper nonlinearly from the top surface 24 to the front face 62. In another alternative upper tapered surface 64 can be tapered partially linearly and partially nonlinearly from the top surface 24 to the front face 62. In one embodiment the top taper angle α can be selected from the range of between about 1 degree and about 89 degrees. In another embodiment the top taper angle α can be selected from the range of between about 5 degrees and about 45 degrees. In another embodiment the top taper angle α can be selected from the range of between about 10 degrees and about 27 degrees.

The lower tapered surface 66 extends upwardly and forwardly from the bottom surface 26 at a bottom taper angle β. In one embodiment the lower tapered surface 66 is planar such that the lower tapered surface 66 defines a lower taper surface plane, and the bottom taper angle β is defined between the bottom surface plane and the lower tapered surface plane. The lower tapered surface 66 can taper linearly from the bottom surface 26 to the front face 62. Alternatively the lower tapered surface 66 can taper nonlinearly from the bottom surface 26 to the front face 62. In another alternative lower tapered surface 66 can be tapered partially linearly and partially nonlinearly from the bottom surface 26 to the front face 62. In one embodiment the bottom taper angle β can be selected from the range of between about 1 degree and about 89 degrees. In another embodiment the bottom taper angle β can be selected from the range of between about 5 degrees and about 45 degrees. In another embodiment the bottom taper angle β can be selected from the range of between about 10 degrees and about 27 degrees. As shown, the top taper angle α can be greater than bottom taper angle β. In alternate embodiments the top taper angle α can be equal to or less than the bottom taper angle β.

The block 20 defines a height H1 measured from the top surface 24 to the bottom surface 26. In one embodiment, the height H1 can be selected from the range of between about 1 inch and about 12 inches. In another embodiment, the height H1 can be selected from the range of between about 2¼ inches and about 4½ inches. The block 20 also defines a depth D1 measured from the front face 62 to the rear surface 32. In one embodiment, the depth D1 can be selected from the range of between about 2 inches and about 24 inches. In another embodiment, the depth D1 can be selected from the range of between about 8 inches and about 12 inches. The block 20 further defines a width W1 measured from the first side surface 28 to the second side surface 30. In one embodiment, the width W1 can be selected from the range of between about 1 inch and about 52 inches. In another embodiment, the width W1 can be selected from the range of between about 2 inches and about 36 inches. In another embodiment, the width W1 can be selected from the range of between about 4 inches and about 18 inches.

As shown, the face portion 60 can define a top taper height H2 measured as the distance from the upper edge 70 to the top surface 24 in the transverse direction. The face portion 60 also defines a bottom taper height H3 measured as the distance from the lower edge 72 to the bottom surface 26 along the transverse direction. In one embodiment, the top and bottom taper heights H2 and H3 can be selected from the range of between about 1/32 inch and about 4 inches. In another embodiment, the top and bottom taper heights H2 and H3 can be selected from the range of between about 1/32 inch and about 1 inch. As shown, the top taper height H2 can be longer than bottom taper height H3. In alternate embodiments the top taper height H2 can be equal to or shorter than the bottom taper height H3. The face portion can also include a front face height H4. The front face height H4 can equal the total height H1 of the block 20 minus the top and bottom taper heights H2 and H3. The top and bottom taper heights H2 and H3 and the front face height H4 can vary slightly along the width W1 of the block 20 to give the front surface 62 a natural stone appearance.

The face portion 60 can further define a top taper depth D2 measured from the front face 62 to the joint between the upper tapered surface 64 and the top surface 24. The face portion 60 also defines a bottom taper depth D3 measured from the front face 62 to the joint between the lower tapered surface 66 and the bottom surface 26. In one embodiment, the top and bottom taper depths D2 and D3 can be selected from the range of between about ¼ inch and about 4 inches. In another embodiment, the top and bottom taper depths D2 and D3 can be selected from the range of between about ½ inch and about 2½ inches. As shown, the top taper depth D2 can be shorter than bottom taper depth D3. In alternate embodiments the top taper depth D2 can be equal to or longer than the bottom taper depth D3.

The face portion 60 can also define a face portion width W2 measured from the first side edge 74 to the second side edge 76. The face portion width W2 can be the same as the width W1 of the body 22 or alternatively the face portion width W2 can be smaller than the width W1 of the body. As will be described in detail below, in one embodiment the face portion width W2 can also vary along the depth of the face portion 60.

Referring to FIGS. 1 and 2, exact dimensions for the top and bottom taper heights H2 and H3, the top and bottom taper depths D2 and D3, the top and bottom taper angles α and β can all be individually selected to achieve the desired characteristics for the shadow line 12 created within the wall 10.

Figure 3:
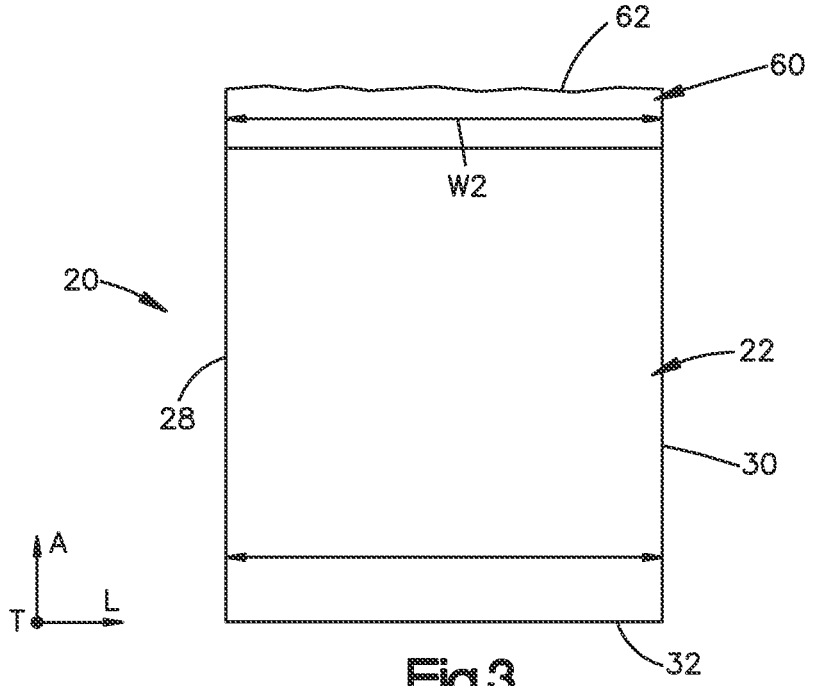
FIG. 3 is a top plan view of the brick illustrated in FIG. 2.

Referring to FIG. 3, an embodiment of the block 20 can include the width W1 of the body 22 being equal to the width W2 of the face portion 60. As shown in the illustrated embodiment, the first and second side surfaces 28 and 30 extend parallel to each other from the rear surface 32 to the front surface 62.

Figure 4:
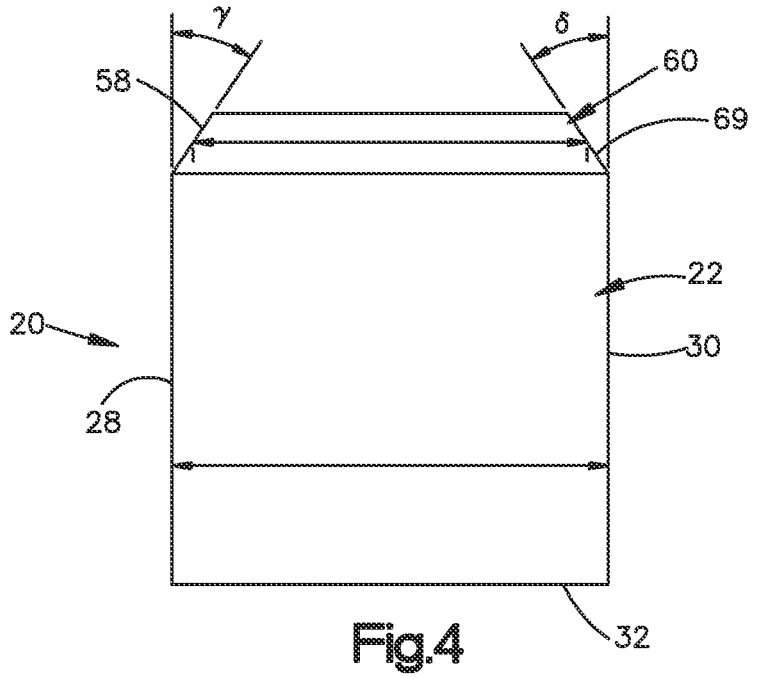
FIG. 4 is a top plan view of the brick illustrated in FIG. 2 according to another embodiment.

Referring to FIG. 4, an alternative embodiment of the block 20 can include the width W1 of the body being greater than the width W2 of the face portion 60. As shown in the illustrated embodiment, the first and second side surfaces 28 and 30 extend parallel to each other from the rear surface 32 to the face portion 60. As shown, the face portion 60 can include first and second side tapered surfaces 68 and 69 which taper from the body 22 to the front surface 62 such that the face portion width W2 gradually decreases from the body 22 to the front surface 62. The gradual decrease of the face portion width W2 can be linear, nonlinear, or partially linear and partially nonlinear. A first side taper angle γ is defined between the first side tapered surface 68 and the plane of the first side surface 28 as shown. A second side taper angle δ is defined between the second side tapered surface 69 and the plane of the second side surface 30 as shown. In one embodiment the first and second side taper angles γ and δ can be selected from between about 1 degree and about 89 degrees. In another embodiment the first and second side taper angles γ and δ can be selected from the range of between about 5 degrees and about 45 degrees. In another embodiment the first and second side taper angles γ and δ can be selected from the range of between about 10 degrees and about 27 degrees. As shown, the first side taper angle γ can be equal to the second side taper angle δ. In an alternate embodiment the first side taper angle γ can be different from the second side taper angle δ.

Figure 5A:
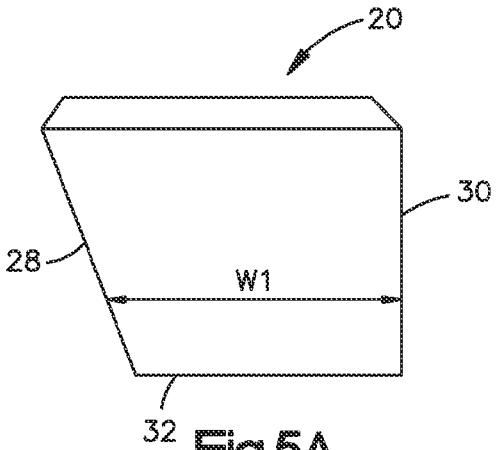
FIG. 5A is a top plan view of the brick illustrated in FIG. 2 according to another embodiment.
Figure 5B:
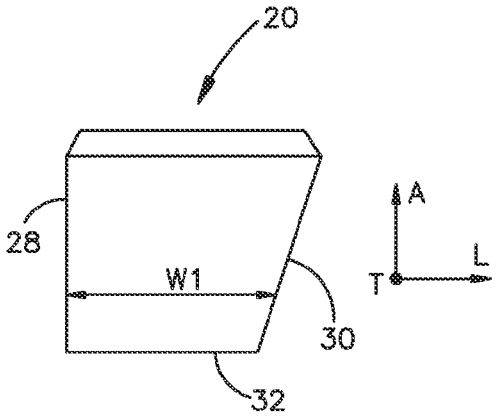
FIG. 5B is a top plan view of the brick illustrated in FIG. 2 according to another embodiment.
Figure 5C:
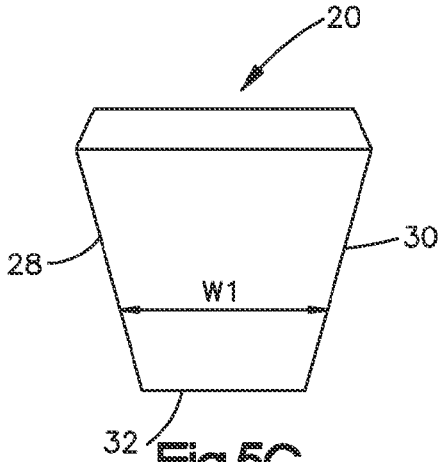
FIG. 5C is a top plan view of the brick illustrated in FIG. 2 according to another embodiment.
Figure 5D:
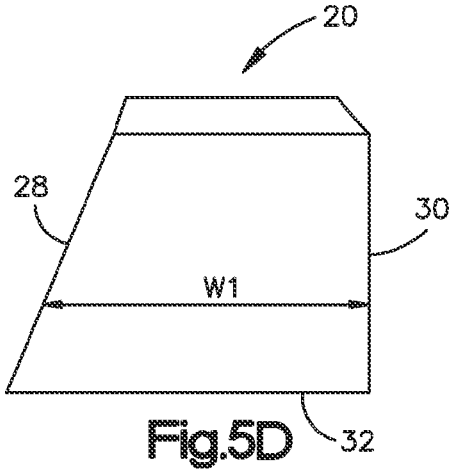
FIG. 5D is a top plan view of the brick illustrated in FIG. 2 according to another embodiment.
Figure 5E:
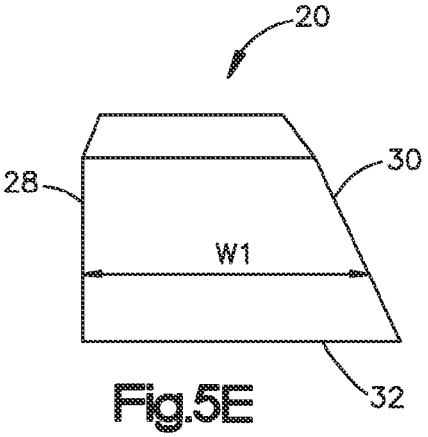
FIG. 5E is a top plan view of the brick illustrated in FIG. 2 according to another embodiment.
Figure 5F:
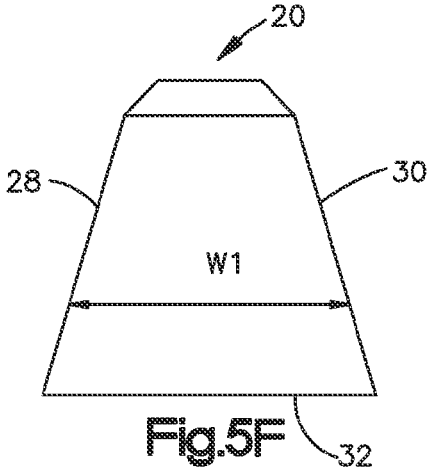
FIG. 5F is a top plan view of the brick illustrated in FIG. 2 according to another embodiment.

Referring to FIGS. 5A-5D, in alternative embodiments of block 20 the first side surface 28 and the second side surface 30 are angularly offset from each other. The first and second side surfaces 28 and 30 can be configured such that as blocks 20 are laid adjacent one another, a curved row is formed. As shown, the first and second side surfaces 28 and 30 can be angularly offset such that the width W1 of the block 20 increases from the rear surface 32 to the face portion 60 (FIGS. 5A-5C) or alternatively the first and second side surfaces 28 and 30 can be angularly offset such that the width W1 of the block 20 decreases from the rear surface 32 to the face portion 60 (FIGS. 5D-5F). In one embodiment a curved row of blocks 20 can be achieved with blocks 20 that have just one of the first and second side walls 28, 30 being non-perpendicular to the rear surface 32 (FIGS. 5A-B and 5D-E). In another embodiment a curved row of blocks 20 can be achieved with blocks 20 that have both of the first and second side walls 28 and 30 being non-perpendicular to the rear surface 32 (FIGS. 5C and 5F).

Referring to FIGS. 1-5F, reference numerals 20, 20', and 20" refer to blocks encompassing all dimensions. The present disclosure is not limited to particular dimensions or configurations that are not expressly stated in the claims. The wall 10 can encompass blocks 20 having various configurations and dimensions.

Figure 6:
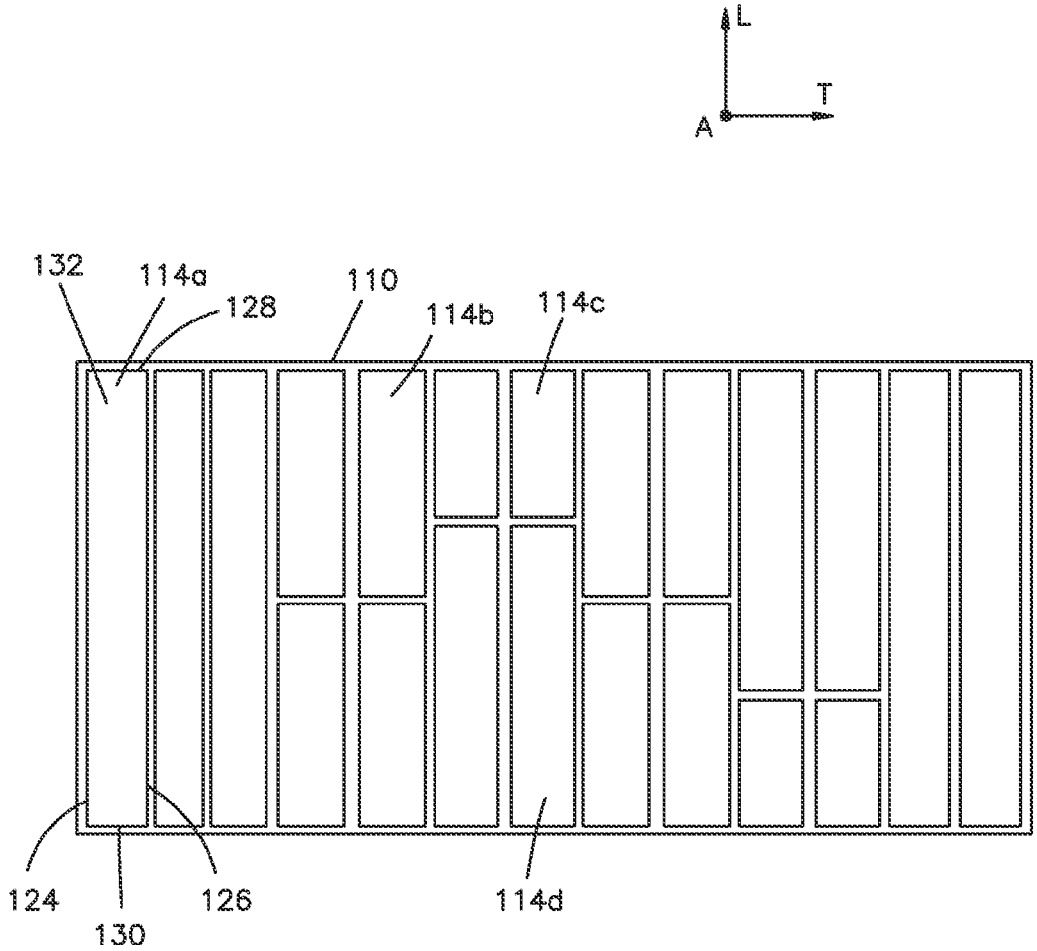
FIG. 6 is a top plan view of a plurality of bricks arranged in a pattern for the forming process.
Figure 7:
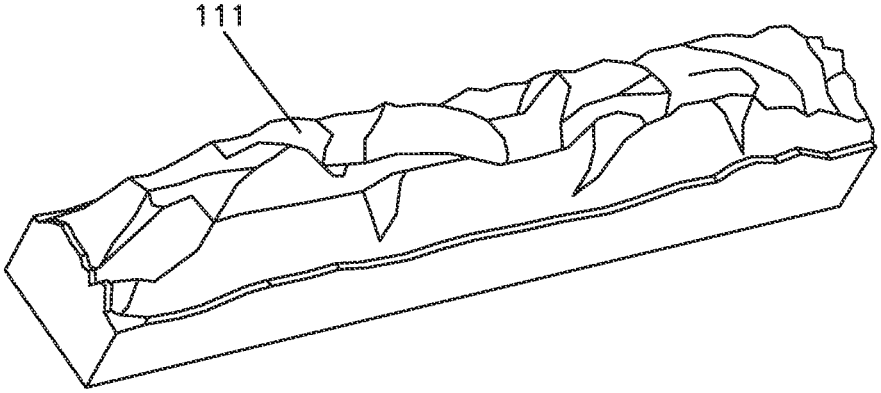
FIG. 7 is a perspective view of a face portion mold.

Referring to FIGS. 6 and 7, a method for forming blocks 20 is also provided. The method preferably employs a multiple compartment mold 110 that is oriented vertically, with the top of the mold visible in FIG. 6. The mold 110 can include cavities 114*a*, 114*b*, 114*c*, and 114*d*. Cavity 114 without an appended letter refers generally to all of the cavities. Accordingly, each cavity 114 can include a pair of opposing long walls 124 and 126 that correspond to upper and lower surfaces 24 and 26 of blocks 20. Additionally, each cavity 114 can include a pair of opposing short walls 128 and 130 that correspond to the first and second side surfaces 28 and 30 of block 20. Each cavity 114 can further include a bottom wall 132 that corresponds to the rear surface 32 of block 20.

In one embodiment, the long cavity 114*a* has a dimension corresponding to the width W1 of the body 22. Cavities 114*b* can be oriented in pairs with a dimension that is roughly half of the dimension of long cavity 114*a* (minus a fraction of an inch for internal mold sidewalls) to produce two blocks 20 with widths W1 that are roughly half that of the block 20 produced in long cavity 114*a*. The cavities 114*c* and 114*d* are oriented together in mold 110 similarly to cavities 114*b* except that the cavity 114*c* has a dimension that is shorter than that of cavity 114*b* and the cavity 114*d* has a dimension that is longer than that of cavity 114*b*. The cavities 114*c* and 114*d* produce two blocks 20 with widths W1 that when combined are roughly equal to that of the block 20 produced in long cavity 114*a*.

The method can additionally employ a compaction head shoe 111 that is used with mold 110 to from a plurality of blocks 20. The compaction head shoe 111 can include an upper tapered surface 164 and a lower tapered surface 166 that correspond to the upper tapered surface 64 and the lower tapered surface 66 of the block 20. In one embodiment the compaction head shoe can further include a first side tapered surface 168 and a second side tapered surface 169 that correspond to the first side tapered surface 68 and the second side tapered surface 69 of block 20. As show, the upper, lower and first and second side tapered surfaces 164, 166, 168, 169 can each be patterned such that the compaction head shoe 111 produces a block 20 that resembles natural stone (for example, either rough field stone or cut stone), as will be understood by persons familiar with the hardscaping industry. For convenience of illustration, only the outer surface of the compaction head shoe 111 is shown, and it is understood that the opposing inner surface (not shown) has the same topography as the outer surface.

To form blocks 20 a mix, preferably a concrete mix suitable for forming blocks for outdoor landscaping use is metered into cavities 114*a*, 114*b*, 114*c*, and 114*d*. The compaction head shoe 111 is then pressed into the concrete mix such that the underside (not shown) of the compaction head shoe 111 impresses its pattern (or topography) into the concrete. The concrete mix is then held under compression at a desired pressure for a desired amount of time. In one embodiment the desired pressure is approximately 10,000 psi and the desired amount of time is between approximately 1 and 5 seconds. In alternate embodiments particular compression parameters can be adjusted for materials, water added, environmental conditions, and other parameters that will be understood by persons familiar with block casting technology. Vibration can be applied to the mold 110 while the compaction head shoe 111 applies pressure to the concrete mix to improve the resulting block 20. Preferably, a compression head shoe 111 for each individual cavity (that is, for mold 110 as shown, twenty-one cavities) has a pattern (or topography) that is unique compared with each other compression head shoe 111. A single press is preferred to actuate the plurality (or bank) of compression head shoes (that is, one press moves 21 compression head shoes 111 into position relative to the cavities and provides the downward force for the entire mold 110). In one embodiment, each of the cavities 114 has substantially uniform dimensions such that the cavities 114 produce blocks 20 with substantially uniform depths and heights.

Accordingly, uncured versions of blocks 20 are formed having various different face portions 60 or profiles, which aids in the appearance of natural stone, although the present disclosure is not limited to this structure or technique. For most commercial blocks, the uncured blocks move from the mold 110 to a furnace for curing, which is conventional. Optional coloring processes may occur at any stage. In one embodiment each block may have a unique coloring scheme to give the appearance of natural stone.

Although the disclosure has been described in detail, it should be understood that various changes, substitutions, and alterations can be made herein without departing from the spirit and scope of the disclosure as defined by the appended claims. Moreover, the scope of the present disclosure is not intended to be limited to the particular embodiments described in the specification. As one of ordinary skill in the art will readily appreciate from the disclosure above, processes, machines, manufacture, composition of matter, means, methods, or steps, presently existing or later to be developed that perform substantially the same function or achieve substantially the same result as the corresponding embodiments described herein may be utilized according to the present disclosure.

What is claimed:

1. A cast block for use in a wall that is configured to be built on a surface, the block comprising:

a body including a top surface, an opposed bottom surface spaced from the top surface by a height of between about 1 inch and about 12 inches, the top surface being substantially planar and defining a top surface plane, the bottom surface being substantially planar and defining a bottom surface plane, and the bottom surface configured to face the surface when used in the wall, the body further including opposed first and second side surfaces, each of the first and second side surfaces extending from the top surface to the bottom surface, and a rear surface extending between the top and bottom surfaces in a first direction and also between the first and second side surfaces in a second direction; and a face portion extending frontwardly from the body, the face portion including a front surface, an upper tapered surface, and a lower tapered surface, the upper tapered surface extending between the top surface and the front surface such that a top taper angle is defined between the upper tapered surface and the top surface plane, the lower tapered surface extending between the bottom surface and the front surface such that a bottom taper angle is defined between the bottom tapered surface and the bottom surface plane, the top taper angle being selected from a range of angles between about 5 degrees and about 45 degrees, the face portion further including a top taper depth and a bottom taper depth, the top taper depth measured frontwardly from an intersection of the top surface and the upper tapered surface to the front surface, such that the top taper depth is between about ¼ inch and about 4 inches, the bottom taper depth measured frontwardly from an intersection of the lower tapered surface and the bottom surface to the front surface, such that the top taper depth is shorter than the bottom taper depth, the face portion configured to cast a shadow line that at least partially covers a cast block positioned below the cast block in the wall;

wherein the body defines a length measured from the rear surface to the face portion, the height of each of the first and second side surfaces is substantially constant along the length of the respective first and second side surface; and the front surface, the upper tapered surface, and the lower tapered surface are each patterned.

2. The block of claim 1, wherein the front surface is disposed at least partially between the top surface plane and the bottom surface plane.

3. The block of claim 2, wherein the top surface plane and the bottom surface plane are substantially parallel to each other and the front surface is substantially perpendicular to the top surface plane and the bottom surface plane.

4. The block of claim 1, wherein at least one of the upper and lower tapered surfaces are at least partially nonlinear.

5. The block of claim 1, wherein at least one of the upper and lower tapered surfaces are at least partially linear.

6. The block of claim 1, wherein the top taper angle is between about 10 degrees and about 27 degrees.

7. The block of claim 1, wherein the bottom taper angle is between about 5 degrees and about 45 degrees.

8. The block of claim 1, wherein the bottom taper angle is between about 10 degrees and about 27 degrees.

9. The block of claim 1, wherein the top taper angle is greater than the bottom taper angle.

10. The block of claim 1, wherein the bottom taper angle is greater than or equal to the top taper angle.

11. The block of claim 1, wherein the height is between about 2¼ inches and about 4½ inches.

12. The block of claim 1, wherein the front surface further comprises an upper edge, a lower edge, and a front surface height defined by a distance between the upper edge and the lower edge of the front surface, and wherein the front surface height is at least 50% of the body height.

13. The block of claim 1, wherein the face portion further comprises a first side tapered surface that extends between the first side surface and the front surface.

14. The block of claim 13, wherein the face portion further comprises a second side tapered surface that extends between the second side surface and the front surface.

15. The block of claim 1, wherein the top taper depth is between about ½ inch and about 2½ inches.

16. The block of claim 1, wherein the bottom taper depth is between about ¼ inch and about 4 inches.

17. The block of claim 16, wherein the bottom taper depth is between about ½ inch and about 2½ inches.

18. The block of claim 1, wherein the opposed first and second side surfaces are parallel to each other.

19. The block of claim 1, wherein the opposed first and second side surfaces are oblique to each other.

20. The block of claim 1, wherein the top surface and the bottom surface are substantially planar and substantially parallel to each other such that the height of the body is substantially constant along the length of the body.

* * * * *